US008523332B2

(12) United States Patent
Drury et al.

(10) Patent No.: US 8,523,332 B2
(45) **Date of Patent: *Sep. 3, 2013**

(54) DROPLET DEPOSITION APPARATUS

(75) Inventors: Paul R. Drury, Royston (GB); Stephen Temple, Cambridge (GB)

(73) Assignee: Xaar Technology Limited, Cambridgeshire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/406,263

(22) Filed: Feb. 27, 2012

(65) Prior Publication Data

US 2012/0204788 A1 Aug. 16, 2012

Related U.S. Application Data

(63) Continuation of application No. 12/296,075, filed as application No. PCT/GB2007/001228 on Apr. 3, 2007, now Pat. No. 8,123,337.

(30) Foreign Application Priority Data

Apr. 3, 2006 (GB) ..... 0606685.6

(51) Int. Cl.
*B41J 2/045* (2006.01)
*B41J 2/14* (2006.01)

(52) U.S. Cl.
USPC ..... 347/69; 347/47; 347/68

(58) Field of Classification Search
None
See application file for complete search history.

(56) References Cited

U.S. PATENT DOCUMENTS

| | | | | |
|---|---|---|---|---|
| 4,104,646 | A | 8/1978 | Fischbeck et al. | |
| 4,992,808 | A | 2/1991 | Bartky et al. | |
| 5,818,481 | A | 10/1998 | Hotomi et al. | |
| 6,074,048 | A | 6/2000 | Hotomi et al. | |
| 6,345,880 | B1 | 2/2002 | DeBoer et al. | |
| 6,431,690 | B1 | 8/2002 | Shinkai et al. | |
| 8,123,337 | B2 * | 2/2012 | Drury et al. | 347/69 |
| 2004/0051762 | A1 | 3/2004 | Nishi et al. | |
| 2004/0207696 | A1 | 10/2004 | Machida et al. | |
| 2005/0078154 | A1 | 4/2005 | Nakano et al. | |
| 2005/0162469 | A1 | 7/2005 | Min et al. | |
| 2005/0195245 | A1 | 9/2005 | Yamada et al. | |
| 2009/0179966 | A1 | 7/2009 | Drury et al. | |

FOREIGN PATENT DOCUMENTS

| | | | |
|---|---|---|---|
| EP | 0 277 703 | A1 | 8/1988 |
| EP | 0 278 590 | A1 | 8/1988 |
| EP | 0309146 | A2 | 3/1989 |
| EP | 0 580 283 | | 1/1994 |

(Continued)

OTHER PUBLICATIONS

Office Action for Japanese Application No. 2009-503646, dated Mar. 29, 2012.

(Continued)

*Primary Examiner* — Geoffrey Mruk
(74) *Attorney, Agent, or Firm* — Marshall, Gerstein & Borun LLP

(57) ABSTRACT

Droplet deposition apparatus comprising an array of fluid chambers defined by a pair of opposing chamber walls, and in fluid communication with a nozzle for droplet ejection therefrom; a cover member is joined to the edges of the chamber walls and thus seals one side of the chambers. The cover member has a ratio of cover thickness to chamber wall separation less than or equal to 1:1.

24 Claims, 12 Drawing Sheets

(56) References Cited

FOREIGN PATENT DOCUMENTS

| | | | |
|---|---|---|---|
| EP | 0 712 355 | A1 | 5/1996 |
| EP | 0 830 945 | | 3/1998 |
| EP | 0 888 888 | | 1/1999 |
| EP | 1 085 061 | | 3/2001 |
| EP | 1 201 433 | | 5/2002 |
| EP | 1 365 457 | | 11/2003 |
| EP | 1 493 569 | | 1/2005 |
| EP | 1 510 342 | | 3/2005 |
| JP | 56-070966 | | 6/1981 |
| JP | 59-159358 | A | 9/1984 |
| JP | 4-241949 | A | 8/1992 |
| JP | 5-229116 | A | 9/1993 |
| JP | 5-338147 | A | 12/1993 |
| JP | 6-234210 | | 8/1994 |
| JP | 9-39241 | | 2/1997 |
| JP | 11-138794 | | 5/1999 |
| JP | 2001-018384 | | 1/2001 |
| JP | 2001-063050 | A | 3/2001 |
| JP | 2001-191541 | A | 7/2001 |
| JP | 2001-246745 | A | 9/2001 |
| JP | 2002-154210 | A | 5/2002 |
| JP | 2002-292861 | A | 10/2002 |
| JP | 2004-114315 | A | 4/2004 |
| JP | 2005-249436 | A | 9/2005 |
| JP | 2006-234215 | A | 9/2006 |
| WO | WO-9117051 | A1 | 11/1991 |
| WO | WO-95/04658 | A1 | 2/1995 |
| WO | WO-99/34981 | | 7/1999 |
| WO | WO-02/098666 | A1 | 12/2002 |
| WO | WO-03/022585 | A1 | 3/2003 |
| WO | WO-03022587 | A1 | 3/2003 |
| WO | WO-2004/067280 | A2 | 8/2004 |

OTHER PUBLICATIONS

International Preliminary Report on Patentability for Application No. PCT/GB2007/001228, dated Oct. 8, 2008.

International Search Report for PCT/GB2007/001228 dated Dec. 28, 2007.

Written Opinion for Application No. PCT/GB2007/001228, dated Feb. 28, 2008.

* cited by examiner

DROPLET DEPOSITION APPARATUS

REFERENCE TO RELATED APPLICATIONS

This is a Continuation under 35 USC §120 of US Pat. application Ser. No. 12/296,075, now U.S. Pat. No. 8,123,337, which is the US National Phase under 35 USC §371 of International Application No. PCT/GB2007/001228, filed Apr. 3, 2007, claiming priority to GB 0606685.6, filed Apr. 3, 2006.

BACKGROUND OF THE INVENTION

1. Field of the Invention

The present invention relates to a component for a droplet deposition apparatus, and more particularly to a cover member for a droplet deposition apparatus. The present invention finds particular application in the field of drop on demand ink jet printing.

2. Related Technology

A known construction of ink jet print head uses piezoelectric actuating elements to create and manipulate pressure waves in a fluid ejection chamber. For reliable operation and sufficient droplet ejection speeds, a minimum pressure must be generated in the chamber, typically about 1 bar. It will be understood that in order to generate such pressures, the chamber must exhibit an appropriate stiffness (or lack of compliance). The compliance of a fluid chamber is therefore an important criterion in the design of the chamber, and there have previously been proposed numerous techniques to keep the compliance of a fluid ejection chamber to a minimum.

For example, EP 0712355 describes a bonding technique providing a low compliance adhesive join. WO 02/98666 proposes a nozzle plate having a composite construction to improve stiffness while still allowing accurate nozzle formation.

In known piezoelectric actuator constructions an array of elongate channels is formed side-by-side in a surface of a block of piezoelectric material. A cover plate is then attached to the surface, enclosing the channels and a nozzle plate, in which orifices for fluid ejection are formed, is also attached. The nozzle plate may overlie the cover plate, with the orifices being formed through the nozzle plate and cover plate through to the channel below. This construction is known as a 'side-shooter' as the nozzles are formed in the side of the channel. It is also known to attach the nozzle plate to the end of the channels in a so-called 'end-shooter' construction.

EP-A-0 277 703 and EP-A-0 278 590 describe a particularly preferred printhead arrangement in which application of an electric field between the electrodes on opposite sides of a chamber wall causes the piezoelectric wall to deform in shear mode and to apply pressure to the ink in the channel. In such an arrangement, displacements are typically of the order of 50 nanometers and it will be understood that a corresponding change in channel dimensions due to channel compliance would result in a rapid loss of applied pressure, with a corresponding drop off in performance.

SUMMARY OF THE INVENTION

The present inventors have found that, surprisingly, in certain arrangements, compliance in the chamber can be tolerated and can even be advantageous.

In a first aspect, the present invention provides droplet deposition apparatus comprising an array of fluid chambers, each fluid chamber defined by a pair of opposing chamber walls, and in fluid communication with a nozzle for droplet ejection therefrom; and a compliant cover component joined to the ends of said chamber walls, thereby sealing one side of said chambers wherein the ratio of cover thickness to chamber wall separation is less than or equal to 1:1.

Preferably the cover component has a Young's modulus of less than or equal to $100\times10^9$ N/m$^2$.

This construction provides a compliant cover component and is therefore in direct contrast to previous teachings, which share the common aim of maximising the stiffness of the channels.

Preferably nozzles are formed in said cover component. This arrangement provides the advantage that the nozzles communicate directly with the channel, rather than through a cover plate aperture. This in turn results in a lower resistance to fluid flow from the chamber to the nozzles, which decreased resistance has been found to offset any loss of performance caused by increased channel compliance.

A second aspect of the present invention provides a droplet deposition apparatus comprising: an array of fluid chambers, each fluid chamber defined by a pair of opposing chamber walls, and in fluid communication with a nozzle for droplet ejection therefrom; and a cover member joined to the edges of said chamber walls, thereby sealing one side of said chambers; wherein the ratio of cover thickness to the chamber wall separation is less than or equal to 1:5 and wherein said cover component has a Young's modulus of less than or equal to 100×109 N/m2.

Experiments carried out on both 'side-shooter' and 'end-shooter' printheads lead to the surprising discovery that cover thicknesses of less than 150 μm may be utilised without significantly effecting ejection properties. Known actuators typically use thicknesses in the region of 900 μm in order to ensure the necessary lack of compliance taught in the prior art.

Therefore, a third aspect of the invention provides droplet deposition apparatus comprising: an array of fluid chambers, each fluid chamber defined by a pair of opposing chamber walls, and in fluid communication with a nozzle for droplet ejection therefrom; and a cover member joined to the edges of said chamber walls, thereby sealing one side of said chambers; wherein the of cover thickness is less than 150 μm.

Preferably, the cover thickness is less than 100 μm, more preferably less than 75 μm, even more preferably less than 50 μm, still more preferably less than 25 μm.

Preferably, the cover thickness is greater than 6 μm, more preferably greater than 8 μm, even more preferably greater than 10 μm.

A fourth aspect of the invention therefore provides droplet deposition apparatus comprising at least one fluid chamber; a compliant cover member bounding said at least one chamber, and carrying at least one nozzle; the chamber undergoing a change in volume upon electrical actuation, so as to cause ejection of fluid from said chamber through said nozzle; wherein the thickness of the cover member is at or close to the value which results in the minimum actuation voltage necessary for fluid ejection.

The cover member preferably has a thickness of not more than 75 μm greater, more preferably not more than 50 μm greater, and even more preferably not more than 25 μm greater than that which results in the minimum actuation signal voltage necessary for fluid ejection.

By achieving a minimal actuation voltage in accordance with the teachings of the present invention the lifetime of the piezoelectric material and so the printhead may be increased by simple changes in the manufacturing process. Indeed, the compliant materials used may themselves simplify the manufacturing process.

In certain embodiments the minimum thickness of the cover member will be closely linked to the material used, and the thicknesses achievable with that material. In certain embodiments then, the cover member preferably has a thickness not less than 50 μm below, more preferably not less than 20 μm below and even more preferably not less than 10 μm below that which results in the minimum actuation signal voltage necessary for fluid ejection.

The chamber preferably comprises a piezoelectric element to effect the change in volume upon actuation, and although it is preferred that the actuating element be distinct from the cover member, the cover member may be arranged to be the actuating element.

A further advantage of the present invention is found in embodiments where fluid flows continuously through the channels. By eliminating the cover plate the flow through the channels passes directly adjacent to the nozzle inlet, resulting in a lower likelihood of entrainment of dirt or bubbles in the nozzles. In addition, with nozzles formed through a relatively thin member, for a given diameter of nozzle, the length of the nozzle from inlet to outlet is reduced.

When bubbles are ingested at the nozzle outlet, then these are more likely to be removed by the flow through the channel.

In embodiments where metal cover members, or metal composite cover members are used, thicknesses below 10 μm and even below 5 μm are conceivable.

Preferably the cover component extends past the ends of said chambers to bound a fluid manifold region, such a one-piece construction offering significant advantages in terms of simplicity of construction.

In this way the same component acts to maintain pressure in the channel upon actuation, but can also advantageously act as an attenuator in the manifold region on account of its compliance. Such attenuation can therefore be provided directly adjacent to the chambers where residual acoustic waves are most prominent. Further away from the chambers, where the span of the cover member can be arranged to be greater, correspondingly greater attenuation can be achieved. This can usefully act to damp pressure pulses generated in the ink supply for example.

A further aspect of the invention therefore provides droplet deposition apparatus comprising an array of fluid chambers, each fluid chamber in fluid communication with a nozzle for droplet ejection therefrom; and a compliant cover component arranged to bound said chambers, wherein said compliant cover component extends away from said chambers additionally to bound a fluid manifold region.

Embodiments of the present invention will employ cover members formed of different materials. An advantage of the present invention is that since high stiffnesses are not required, materials having a relatively low Young's modulus can be employed. Polymers or plastics materials are advantageous in simplifying manufacture. Nozzles can be formed in such materials relatively easily by laser ablation or by photolithography. Particularly preferable materials are Polyimide and SU-8 photoresist. SU-8 in particular is advantageous as it is solution processable, and can be spin coated to form layers of only a few microns in thickness. PEEK (Polyetheretherketones) may also be used owing to their high resistance to thermal and chemical degradation and excellent mechanical properties.

Thus, a further aspect of the present invention provides a method of manufacturing a component for a droplet deposition apparatus, the method comprising: providing a compliant base component having formed thereon a plurality of chamber walls; forming on said compliant base conductive tracks to provide electrical connection to electrodes formed on said chamber walls.

In embodiments the compliant base may be a flexible circuit board and the conductive tracks formed thereupon advantageously used to connect the chamber walls to drive circuitry.

A still further aspect of the present invention provides droplet deposition apparatus comprising at least one fluid chamber in fluid communication with a nozzle for droplet ejection therefrom; and a compliant cover member bounding said at least one chamber; the chamber undergoing a change in volume upon electrical actuation, so as to cause ejection of fluid from said chamber through said nozzle; wherein the cover member is formed entirely of a polymer.

Preferably the cover member is less than 100 μm in thickness, more preferably less than 50 μm, and still more preferably less than 20 μm.

BRIEF DESCRIPTION OF THE DRAWINGS

The present invention will now be described by way of example with reference to the accompanying drawings in which.

DETAILED DESCRIPTION

Figure 1:
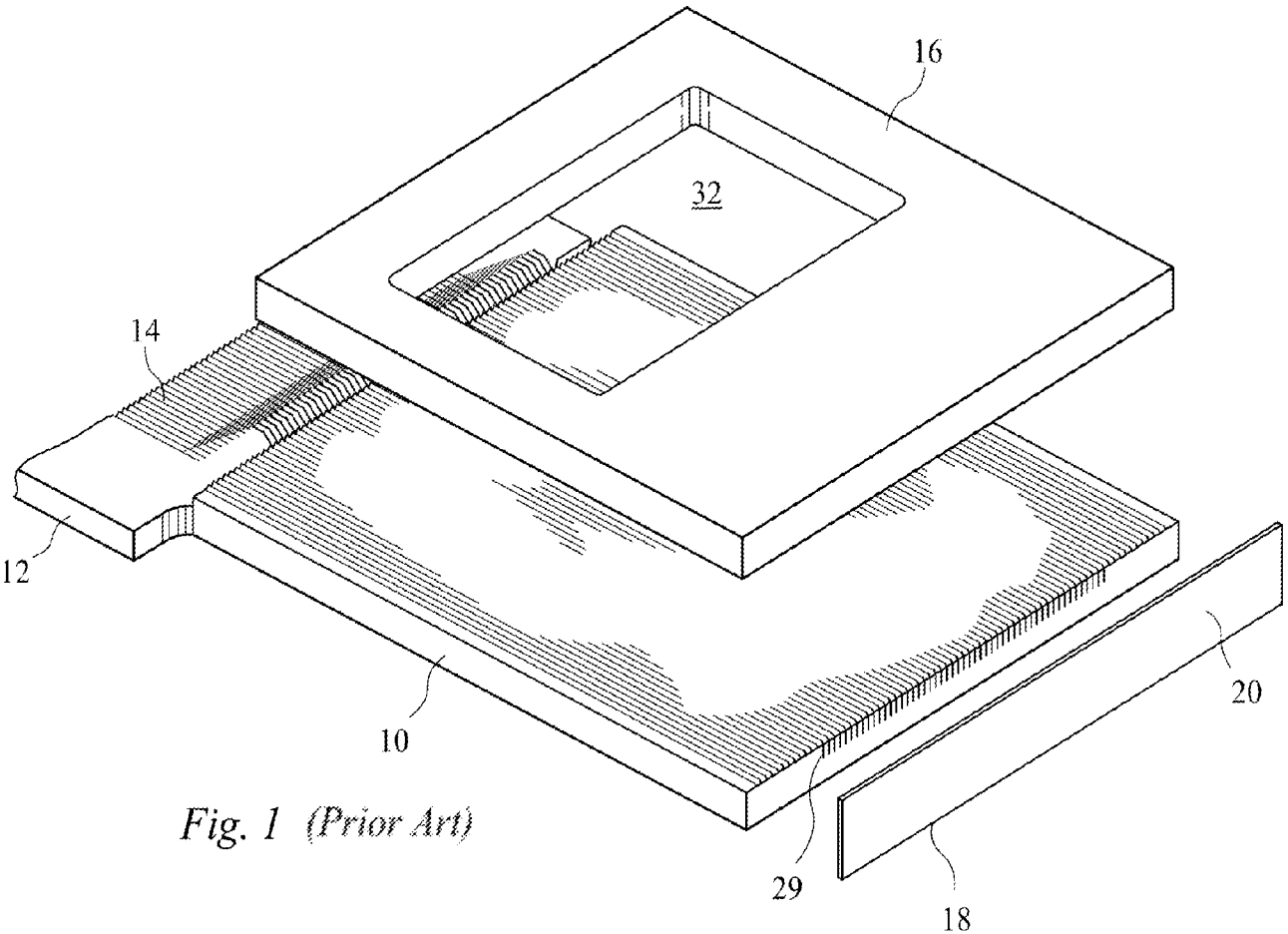
Fig. 1 (Prior Art)
FIGS. 1 and 2 show a prior art 'end-shooter' construction.

FIG. 1 shows as an exploded view in perspective, a known ink jet printhead incorporating piezo-electric wall actuators operating in shear mode. It comprises a base 10 of piezoelectric material mounted on a circuit board 12 of which only a section showing connection tracks 14 is illustrated. A plurality of elongate channels 29 are formed in the base. A cover 16, which is bonded during assembly to the base 10 is shown above its assembled location. A nozzle plate 18 is also shown adjacent the printhead base, having a plurality of nozzles (not shown) formed therein. This is typically a polymer sheet coated on its outer surface with a low energy surface coating 20.

The cover component 16 illustrated in FIG. 1 is formed of a material thermally matched to the base component 10. One solution to this is to employ piezo-electric ceramic similar to that employed for the base so that when the cover is bonded to the base the stresses induced in the interfacial bond layer are minimised. A window 32 is formed in the cover which provides a supply manifold for the supply of liquid ink into the channels 29. The forward part of the cover from the window to the forward edge of the channels, when bonded to the tops of the channel walls determines the active channel length, which governs the volume of the ejected ink drops.

Figure 2:
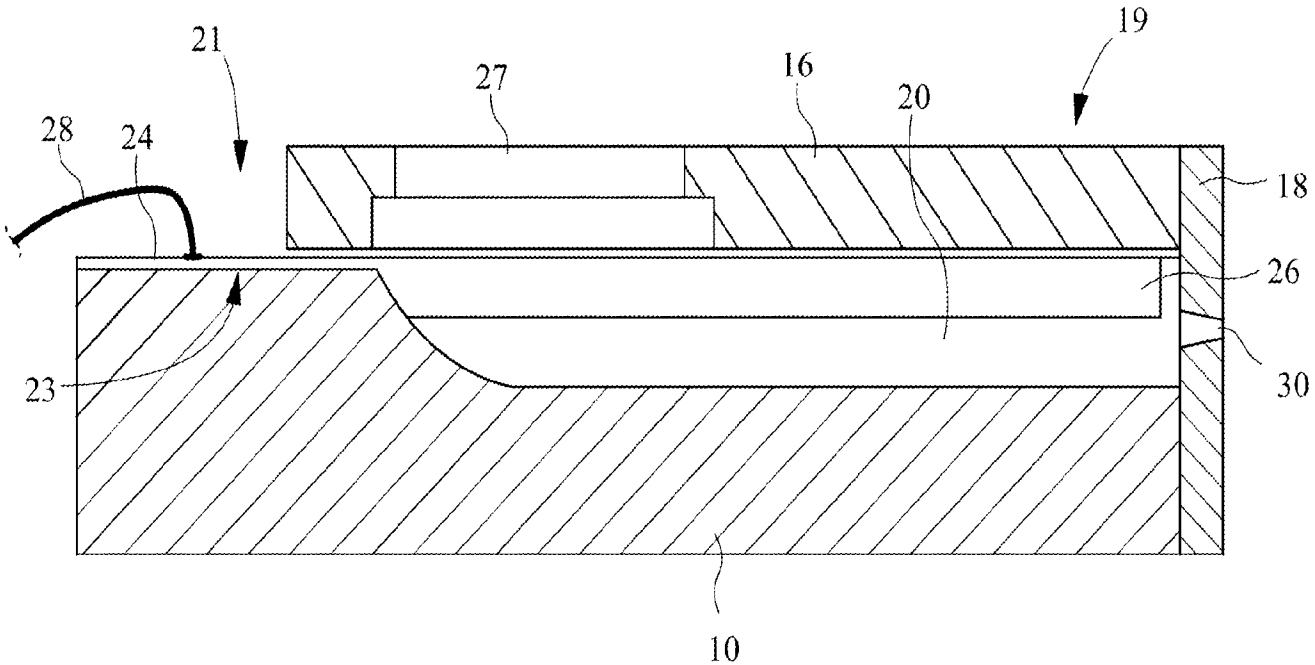
Fig. 2 (Prior Art)

WO 95/04658 discloses a method of fabrication of the printhead of FIGS. 1 and 2, and notes that the bond joining the base and the cover is preferably formed with a low compliance so that the actuator walls, where they are secured to the cover 16, are substantially inhibited from rotation and shear.

It will be understood that the cover must itself be substantially rigid for such movements to be inhibited.

FIG. 2 shows a section through the arrangement of FIG. 1 after assembly, taken parallel to the channels. Each channel comprises a forward part which is comparatively deep to provide ink channels 20 separated by opposing actuator walls 22 having uniformly co-planar top surfaces, and a rearward part which is comparatively shallow to provide locations 23 for connection tracks. Forward and rearward parts are connected by a "runout" section of the channel, the radius of which is determined by the radius of the cutting disc used to form the channels. The nozzle plate 18 is shown in this diagram after it has been attached by a glue bond layer to the printhead body and following the formation of nozzles 30 in the nozzle plate by UV excimer laser ablation. The arrangement of FIGS. 1 and 2 is commonly referred to as an 'end shooter' arrangement since the nozzles are located at the ends of the channels.

In operation, the channel walls deform in shear mode and generate acoustic waves adjacent the manifold 27. These waves travel along the length of the channel to the nozzle 30, where they cause ejection of fluid droplets.

It is desirable with such 'end-shooter' constructions to stack several identical actuator structures to give multiple parallel rows of nozzles. In accordance with the teachings of the present invention, the compliance of the cover member may be reduced below known limits by reducing the thickness of the cover component 16. This allows the actuators to be stacked more closely thereby increasing nozzle density in the print direction and so the printing speed of the print head.

Figure 3:
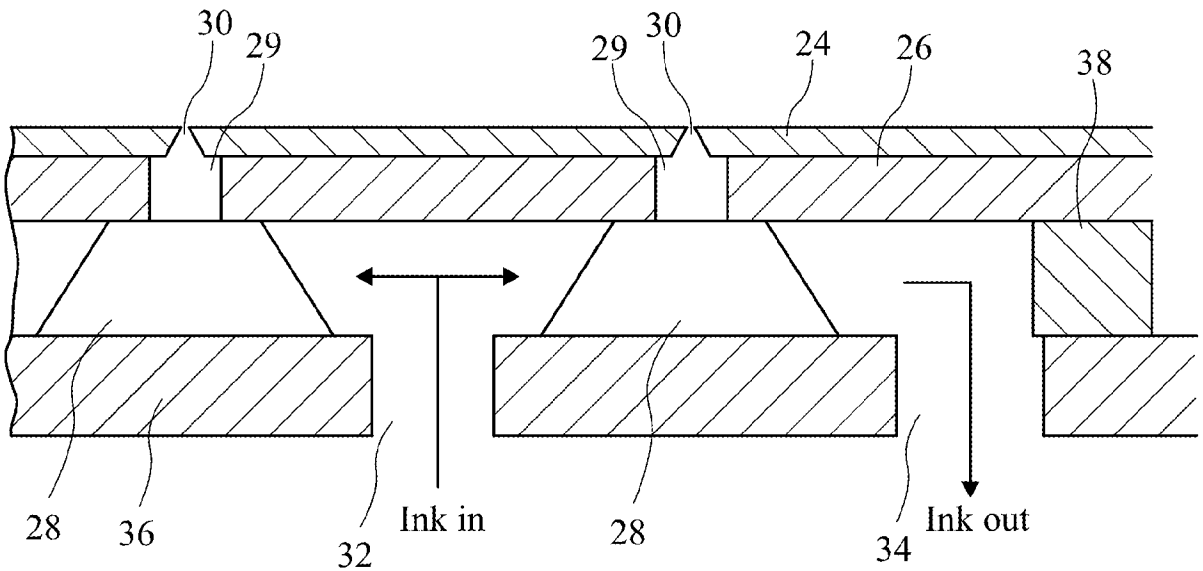
Fig. 3 (Prior Art)
FIGS. 3 and 4 show a prior art 'side-shooter' construction.
Figure 4:
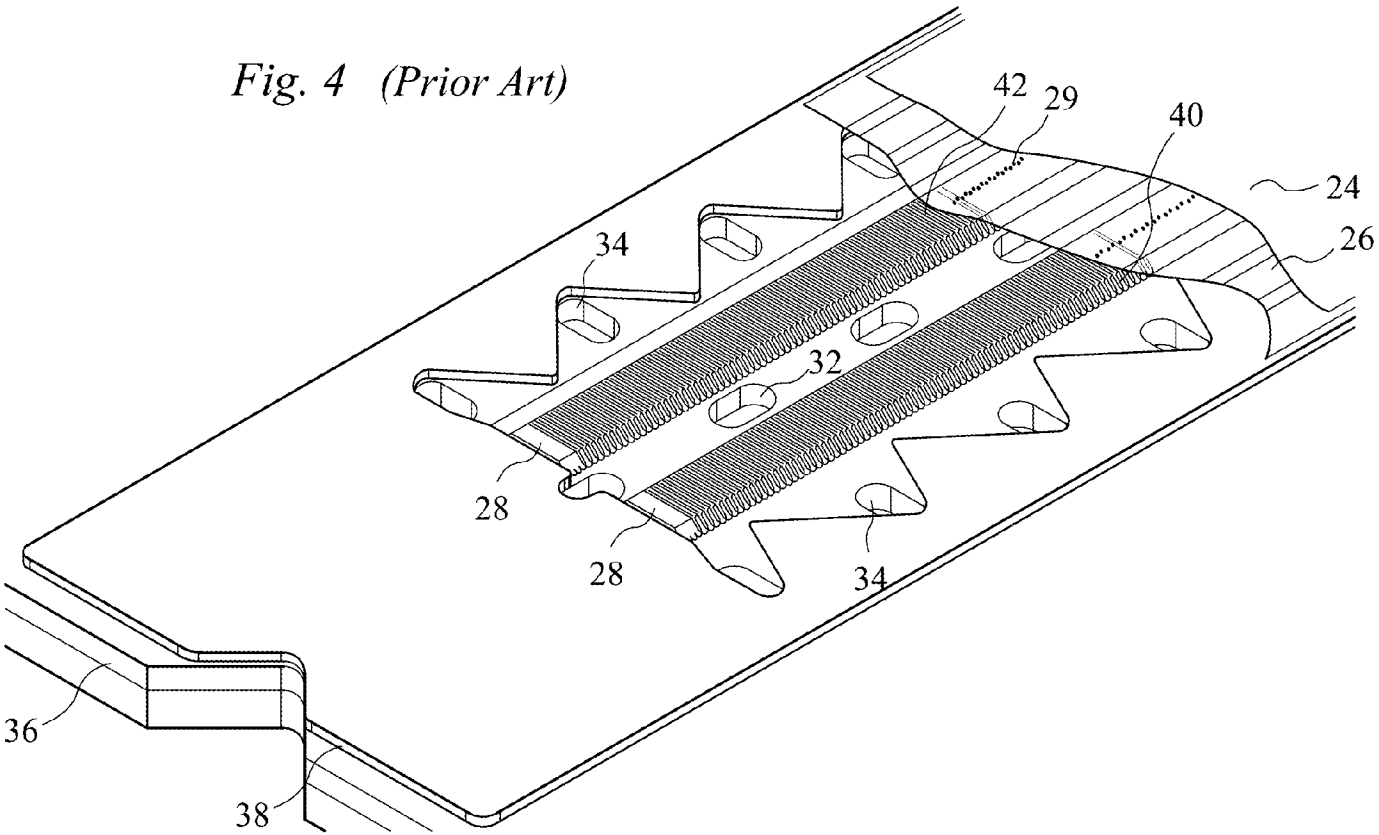
Fig. 4 (Prior Art)

FIGS. 3 and 4 are taken from WO 03/022585. FIG. 3 illustrates an alternative prior art printhead construction, referred to as a 'side-shooter'. An array of channels, formed in an piezoelectric member 28 elongate in the array direction, are closed by a cover member 26, having apertures 29. A nozzle plate is attached to the cover member with nozzles 30 communicating with apertures 29. In this arrangement it is known to have a double ended channel, and ink is supplied from a manifold region 32 and ejected from nozzles 30 located midway between along channels 28. In this way fluid is ejected from the side of the channel. A continuous flow is set up between the inlet manifold 32 and two outlet manifolds 34 (only one is visible in this figure).

The channel is typically sawn using a diamond-impregnated circular saw, in a block of a piezoelectric ceramic and in particular PZT. The PZT is polarised perpendicular to the direction of elongation of the channels and parallel to the surface of the walls that bound the channel. Electrodes are formed on either side of the walls by an appropriate method and are connected to a driver chip (not shown) by means of electrical connectors. Upon application of a field between the electrodes on opposite sides of the wall, the wall deforms in shear mode to apply pressure to the ink in the channel. This pressure change causes acoustic pressure waves in the channels, and it is these pressure waves which result in ejection of droplets—so called acoustic firing.

FIG. 4 is a perspective cut away view of a printhead operating according to the principles of FIG. 3. A nozzle plate 24 is bonded to a cover component 26 that is further bonded to the upper surface of the elongate piezoelectric members 28 in which the ejection channels are formed. The cover component has a straight edged port 29 connecting the nozzles 30 (not shown in FIG. 4) and the ejection channels. Ink flows through the channels from manifolds 32 and 34 formed in a base component 36. Manifold 32 acts as a fluid inlet, the fluid through the channels of the two piezoelectric members 28—even during printing—and the manifolds 34 act as fluid outlets. Whilst two arrays of channels with a single inlet and two outlets have been described many alternative constructions to enable continuous fluid flow through channel arrays are possible, for example only a single array of channels may be utilised.

As noted in WO 03/022585 the cover component, although a cause of nozzle blockage, serves to provide structural stability to the nozzle. This document also teaches that attempts to use a nozzle plate in isolation will tend to result in insufficient stiffness to maintain the pressure in the chamber upon actuation without flexing.

Figure 5:
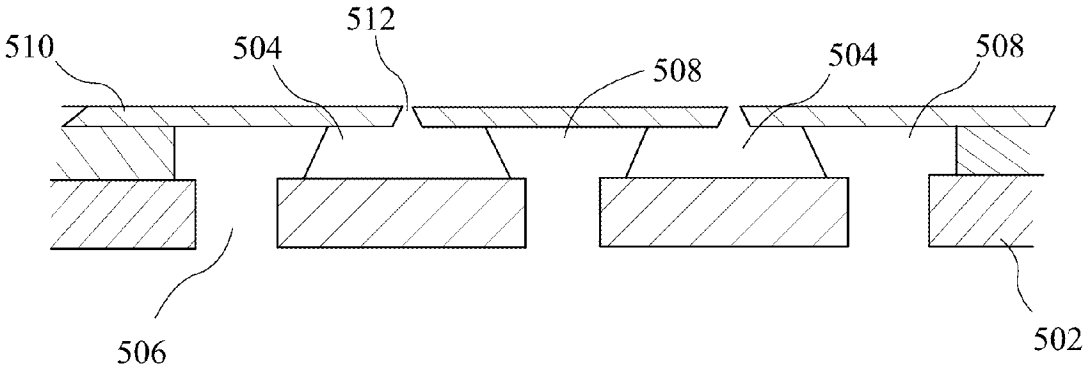
FIGS. 5, 6 and 9 illustrate embodiments of the present invention.

FIG. 5 shows an arrangement according to an aspect of the present invention. A substrate 502 is provided with two rows of piezoelectric channels 504. Apertures 506 in the substrate provide passage of ink to and from manifold regions 508. The channels and the manifold regions are closed at the top by a cover component 510. The cover component can be seen to be relatively thin, and is made of polyimide. Nozzles 512 are formed in the cover plate and communicate directly with channels 504. The method of actuation to form acoustic waves is as described above. Where the scanning direction is parallel to the plane of the cover member, accelerations caused by scanning of the printhead will advantageously not tend to deform the compliant cover member.

Figure 6:
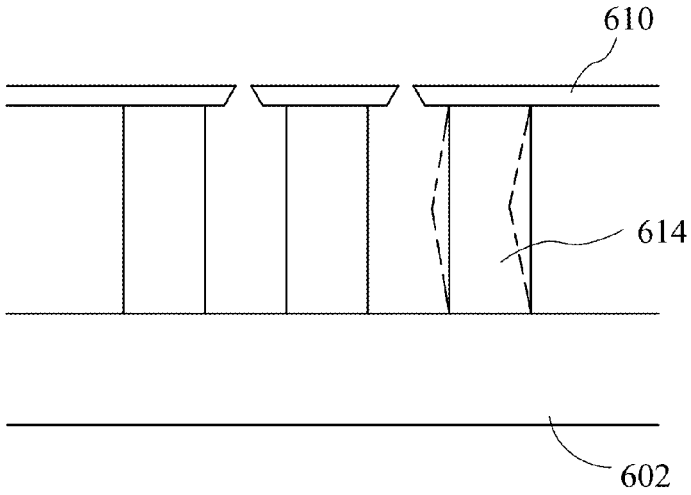

FIG. 6 is a view of the arrangement of FIG. 5 taken along the channels. It can be seen that while the base 602 is relatively thick compared to the channel separation, the thickness of cover member 610 is less than the channel spacing. Upon actuation, wall elements 614 deform in a chevron configuration as shown in dashed line. This method of actuation is described in detail in EP 0277703, and will not be described here in detail, save to note that because the top and bottom portions of the wall deform in opposite senses, the resulting stresses applied to the cover member are reduced.

Figure 7A:
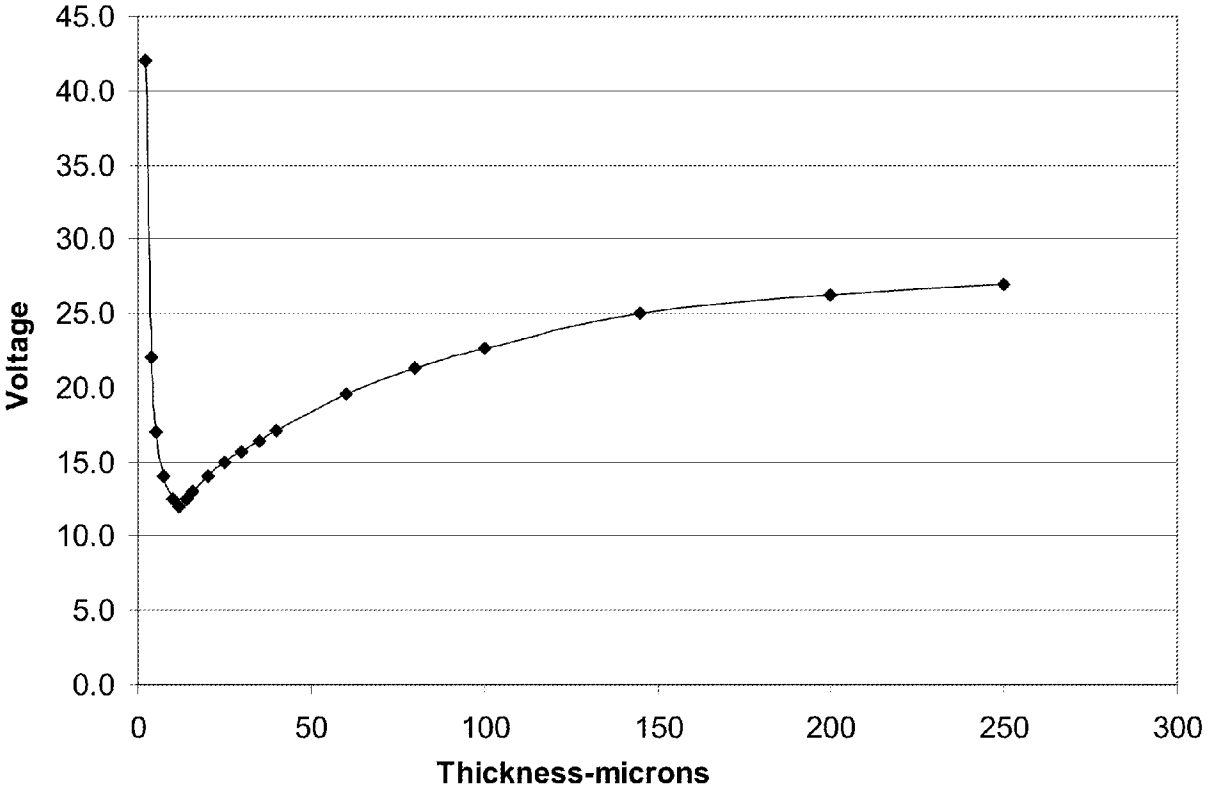
FIGS. 7 and 8 show variations in actuation voltage with cover thickness of an actuator according to aspects of the present invention.
Figure 7B:
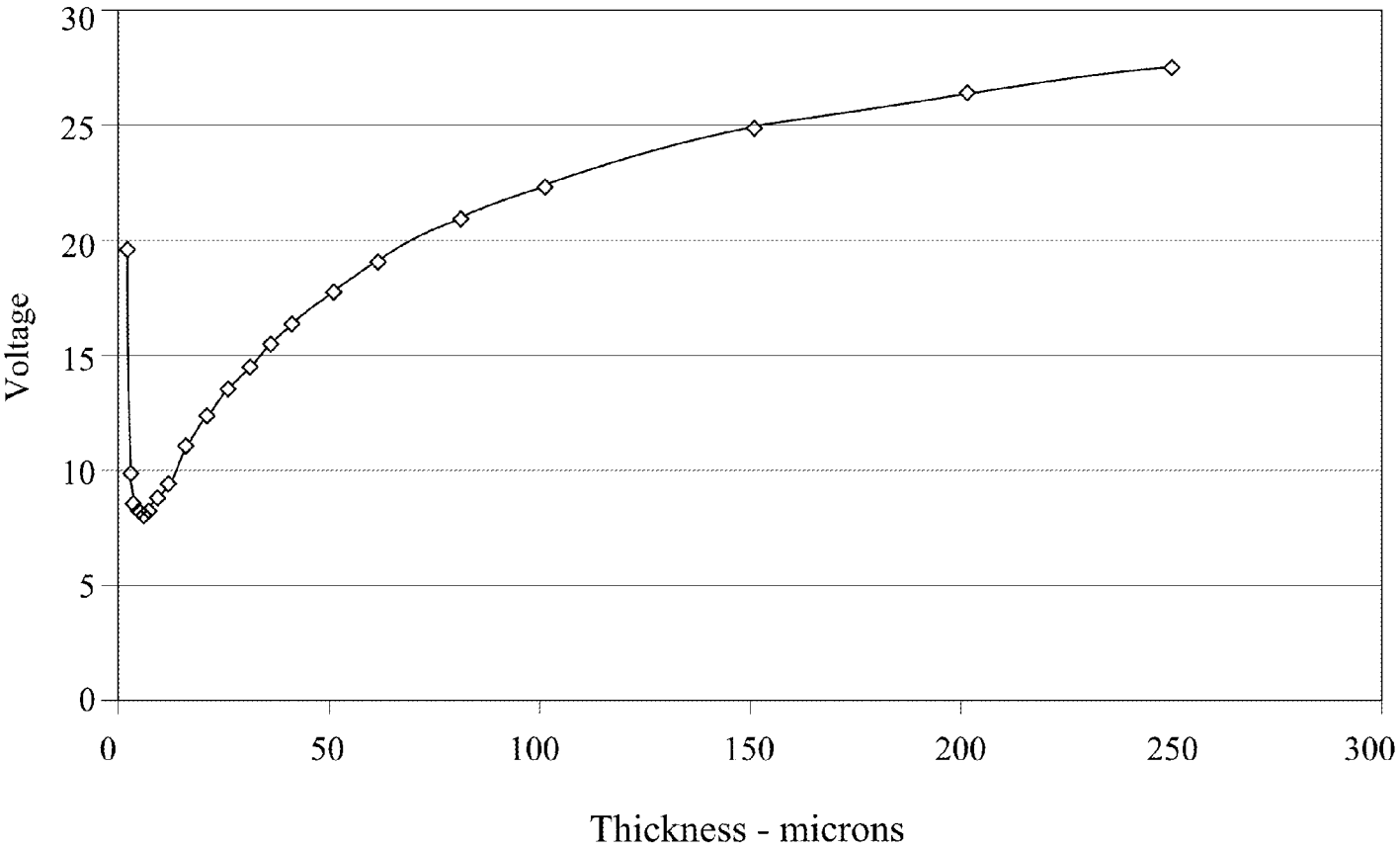

FIG. 7 shows graphs of operating voltage against cover thickness for an actuator as depicted in FIGS. 5 and 6. FIG. 7*a* plots results for an actuator initially having a 100 μm thick Polyimide cover member, which when optimised—according to conventional techniques—for operation at 6 m/s delivering 4 pl per sub-drop requires 22.6V driving voltage. From this starting point the cover thickness is varied and the required voltage re-optimised to maintain the 6 m/s ejection velocity at that thickness. FIG. 7*b* shows an equivalent graph for a cover member made of Alloy 42, a Ni/Fe alloy.

It can be seen from both graphs that, while the values vary for different cover materials, the form of the graph is the same—the necessary operating voltage to achieve reliable ejection exhibits a minimum at a corresponding optimised thickness value.

The form of the graph is determined by two opposing effects of cover member thickness on efficiency. The first effect is that a reduced cover thickness results in less resistance to flow through the nozzle giving greater ejection efficiency. The second is that reduced cover thickness reduces the compliance of the channel giving lesser ejection efficiency. The combination of these two effects results in an optimum thickness in terms of actuation voltage. At values significantly below this thickness the low channel compliance dominates, and efficiency reduces sharply. At value greater than this thickness, nozzle resistance becomes increasingly significant, and efficiency is again reduced.

Figure 8:
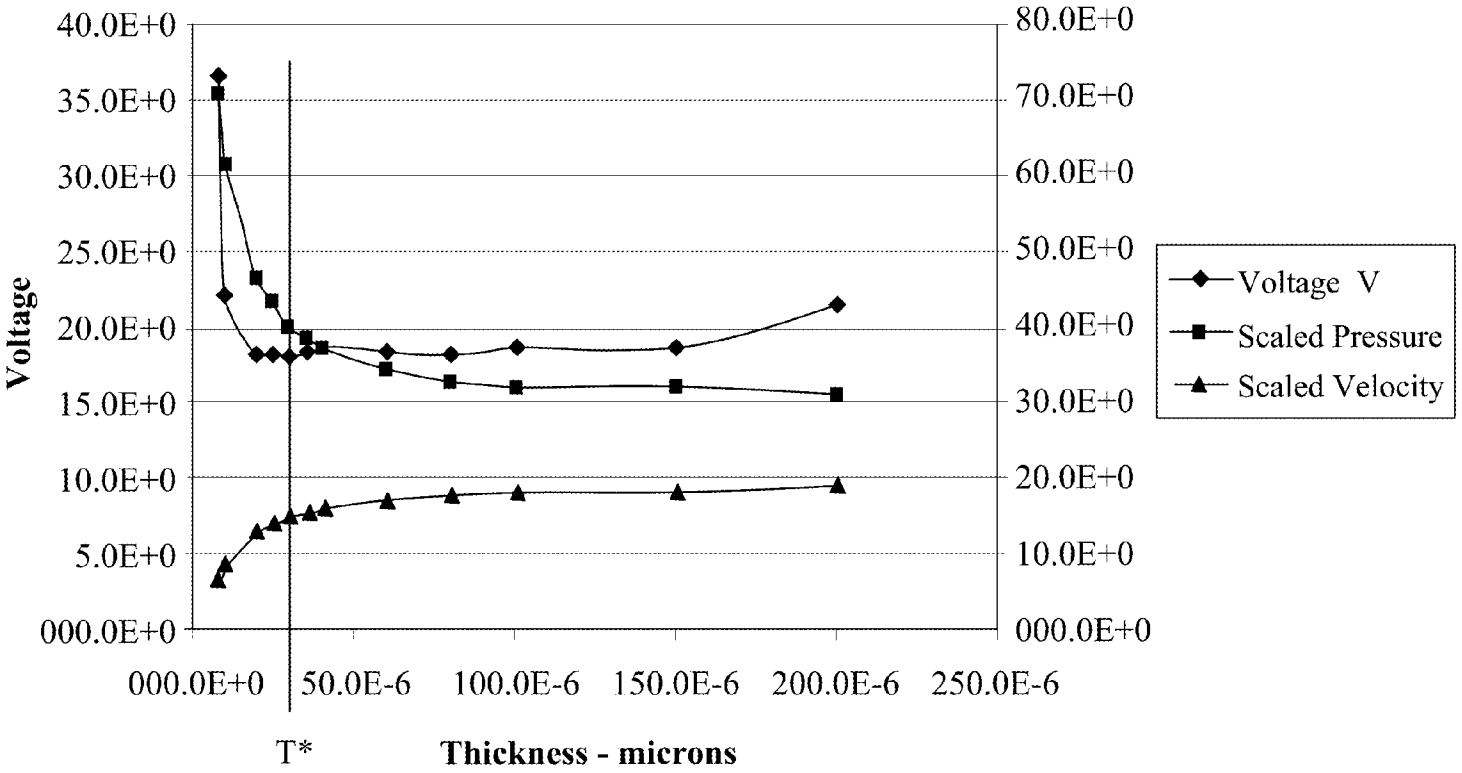

FIG. 8 is a graph of optimised operating voltage against cover thickness for an actuator as depicted in FIGS. 5 and 6. FIG. 8 shows that even when other actuator parameters are optimised to provide the minimum operating voltage for a given cover thickness, the graph again exhibits a minimum voltage, although less well defined, at an optimised cover thickness, T*.

A preferred range of values of thickness therefore exists. Because of the asymmetry of the graphs, thicknesses of up to 10% or even 20% less than the optimised thickness are advantageous, while thicknesses of up to 25% or even 50% greater than the optimised thickness can lie within the preferred range.

Figure 9:
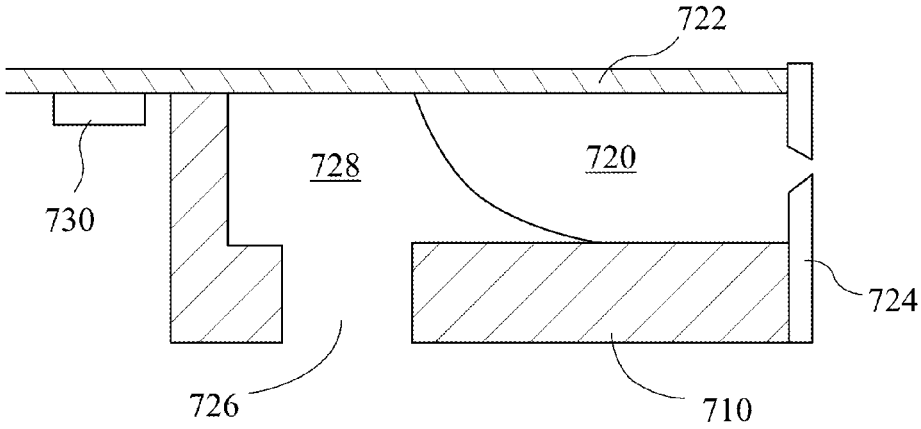

FIG. 9 shows an embodiment of the present invention in an end shooter configuration. Here a body 710 of PZT is formed with channels 720. A compliant cover member 722 closes the tops of the channels, and a nozzle plate 724 is bonded to the end of the assembly. An aperture 726 is provided in the body for supplying ink to a manifold region 728. This arrangement can therefore be considered as an inverted version of the more conventional end shooter construction shown in FIG. 2, with the compliant member 722 effectively forming the base, on which a channel and manifold structure is provided. Drive electronics 730 can be provided on the compliant member 722, which may be a flexible circuit board, along with tracks to make electrical connections to the channel electrodes.

Figure 10A:
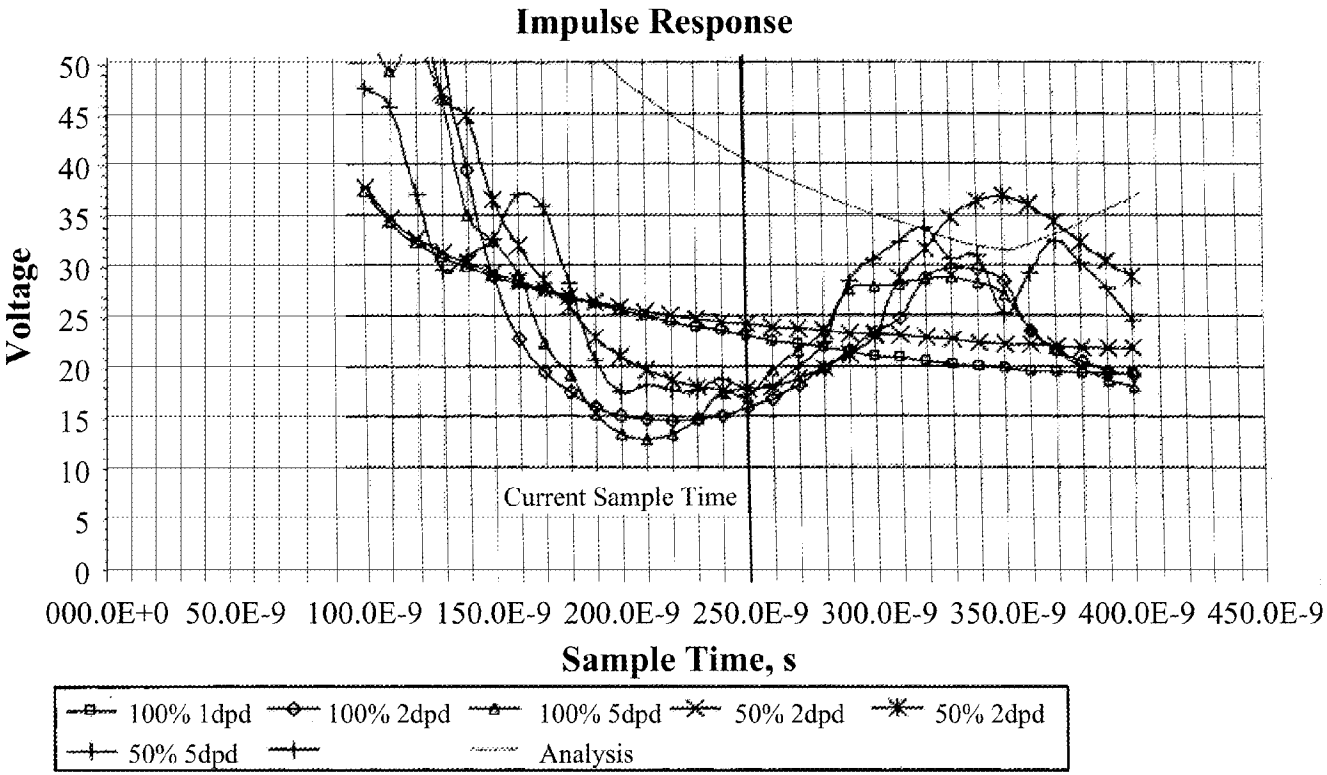
FIG. 10 shows impulse response characteristics of an embodiment of the present invention.
Figure 10B:
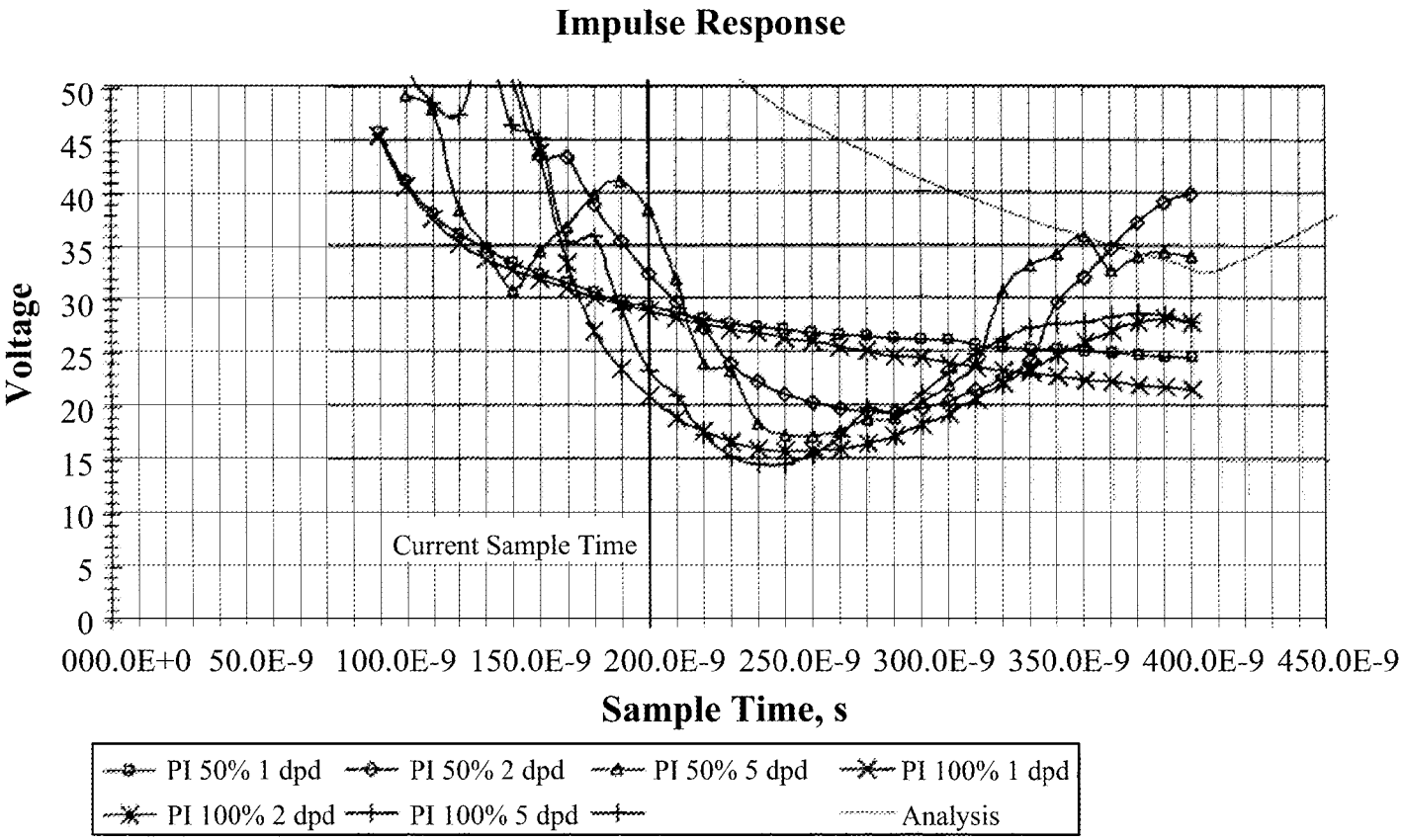

FIG. 10 shows simulated response curves for an end shooter actuator. FIG. 10*a* shows impulse response curves using a thick piezoelectric cover component, while FIG. 10*b* shows the equivalent impulse response with a polyimide cover having a thickness of 50 μm.

It can be seen that while there is a shift to longer sample periods for the polyimide cover, and a shift upwards in voltage, the form of the curves are substantially the same, particularly close to the normal operating region of around 0.3 μs.

In an assembled printhead the length of the channels determines the time taken for an acoustic wave to travel along the channel and so limits the time between successive ejections—the operating frequency of the printhead. In order to drive a printhead at desirable frequencies the channel length must therefore be maintained in a fixed range. The width of the channel is closely related to the nozzle spacing and so the resolution achievable by the printhead. Thus, the length and width of the channels may be assumed constant as they are determined by operation and manufacturing parameters.

Hence, the compliance of the cover member is in practice determined by the thickness and Young's modulus of the cover member.

Figure 11:
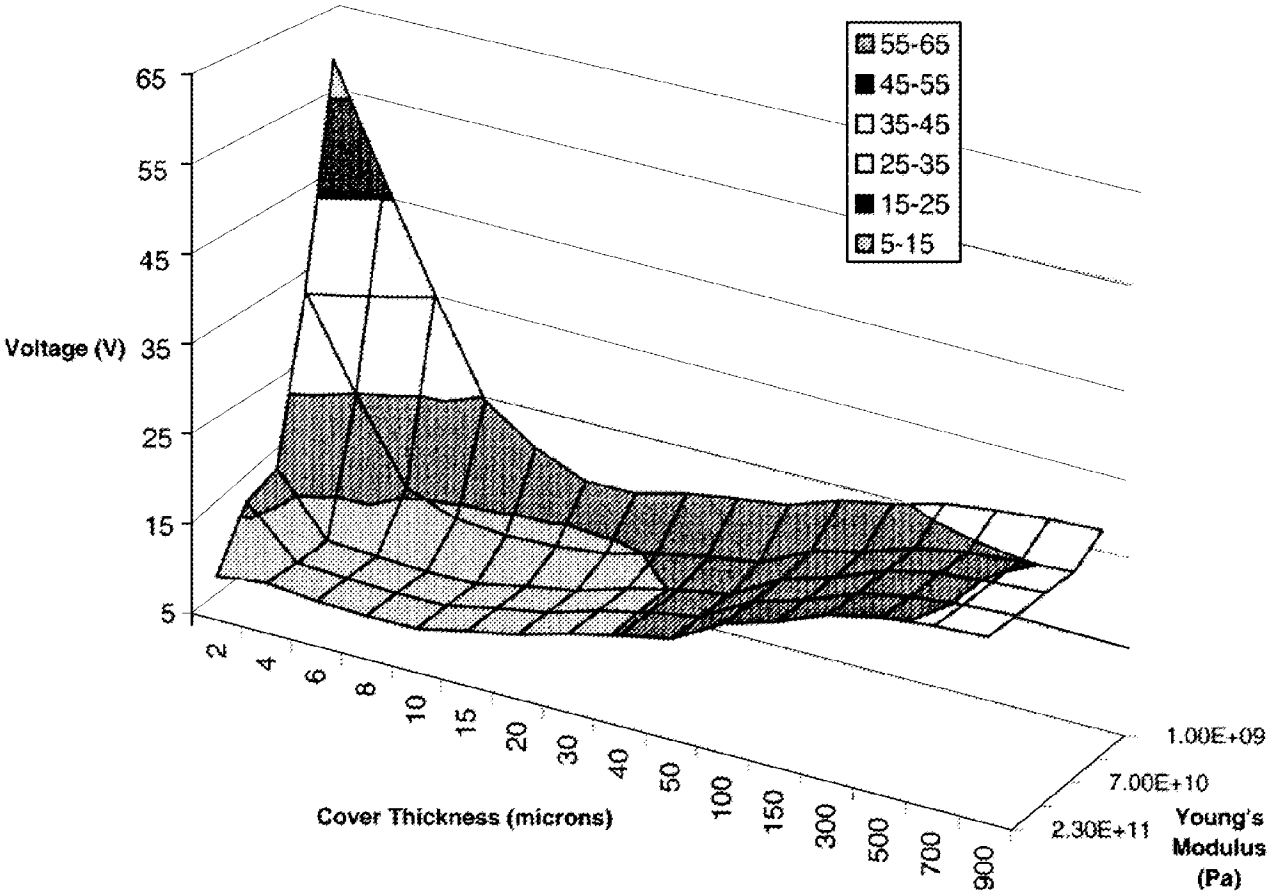
FIG. 11 shows variations in actuation voltage with cover thickness and Young's modulus of an actuator according to aspects of the present invention

FIG. 11 shows a graph of optimised operating voltage against the thickness and Young's modulus of the cover for an actuator as depicted in FIGS. 5 and 6. The five data series for Young's modulus correspond respectively to Polyimide (4.8 GPa), Aluminium (70 GPa), PZT (110 GPa), and Nickel (230 GPa), which are all materials commonly used in cover plate construction. FIG. 11 shows that even when the Young's modulus is altered the cover thickness that achieves minimum actuation voltage remains roughly constant between 10-15 microns. In a known printhead actuator the cover thickness is 900 microns, thus thicknesses anywhere between 5-150 microns may exhibit marked improvements in minimising actuation voltage.

Whilst reference has been made herein to polyimide and SU-8 as suitable materials for a cover member, the skilled reader should appreciate that many polymers, metals and alloys capable of forming a thin film may be used. Flexible circuit board materials may be advantageously employed, especially where electrical tracks are formed during the fabrication process.

The invention claimed is:

1. Droplet deposition apparatus comprising:

an array of fluid chambers, each fluid chamber defined by a pair of opposing chamber walls separated one from the other by a chamber wall separation, and in fluid communication with a nozzle for droplet ejection therefrom, each of said fluid chambers and said opposing chamber walls being elongate in a first direction, each of said opposing chamber walls deforming in shear mode in a chevron configuration upon application of an electric field thereto, wherein a top portion and a bottom portion of said chamber wall deform in opposite senses, and having an edge extending in said first direction; and a cover member joined to said edges of said chamber walls, thereby sealing one side of said chambers, the cover member having a cover thickness;

wherein the ratio of cover thickness to chamber wall separation is less than or equal to 1:1; and wherein said nozzles are formed in said cover member and the cover member has a Young's modulus of less than or equal $100\times10^9$ N/m$^2$.

2. Apparatus according to claim 1, wherein said chamber walls comprise piezoelectric material and deform in shear mode.

3. Apparatus according to claim 1, wherein said cover member is formed of a polymer.

4. Apparatus according to claim 1, wherein said cover member is formed of an alloy.

5. Apparatus according to claim 1, wherein said cover member is of composite construction.

6. Apparatus according to claim 1 wherein said cover member comprises a photoresist material.

7. Droplet deposition apparatus comprising:

an array of fluid chambers, each fluid chamber defined by a pair of opposing chamber walls separated one from the other by a chamber wall separation, and in fluid communication with a nozzle for droplet ejection therefrom, each of said fluid chambers and said opposing chamber walls being elongate in a first direction, each of said opposing chamber walls deforming in shear mode in a chevron configuration upon application of an electric field thereto, wherein a top portion and a bottom portion of said chamber wall deform in opposite senses, and having an edge extending in said first direction; and a cover member joined to said edges of said chamber walls, thereby sealing one side of said chambers;

wherein the thickness of the cover member is less than 150 μm; and wherein said nozzles are formed in said cover member and said cover member is formed of a polymer.

8. Apparatus according to claim 7, wherein said cover member is formed of polyimide or of a polyether ether ketone.

9. Apparatus according to claim 7, wherein the cover member has a Young's modulus of less than or equal to $100\times10^9$ N/m$^2$.

10. Apparatus according to claim 7, wherein said cover member comprises a photoresist material.

11. Droplet deposition apparatus comprising:

an array of fluid chambers, each fluid chamber defined by a pair of opposing chamber walls separated one from the other by a chamber wall separation, and in fluid communication with a nozzle for droplet ejection therefrom, each chamber wall deforming in shear mode in a chevron configuration upon application of an electric field thereto, wherein a top portion and a bottom portion of said chamber wall deform in opposite senses, and having an edge extending in a first direction, each of said fluid chambers extending in said first direction from a first longitudinal end to a second, opposing longitudinal end;

a fluid inlet manifold, in fluid communication with the first longitudinal ends of said fluid chambers;

a fluid outlet manifold, in fluid communication with the second longitudinal ends of said fluid chambers; and a compliant cover component having a cover thickness and being joined to said edges of said chamber walls, thereby being arranged to bound said chambers wherein said nozzles are formed in said cover member and the ratio of cover thickness to chamber wall separation is less than or equal to 1:1.

12. Apparatus according to claim 11, wherein said cover member is formed of a polymer.

13. Apparatus according to claim 11, wherein said compliant cover component extends beyond said chambers additionally to bound at least a portion of at least one of said fluid inlet manifold and said fluid outlet manifold.

14. Apparatus according to claim 11, wherein each of said fluid chambers and said opposing chamber walls are elongate in said first direction.

15. Apparatus according to claim 11, wherein the cover member has a Young's modulus of less than or equal to $100\times10^9$ N/m$^2$.

16. Apparatus according to claim 11, wherein in use of the apparatus there is a flow of fluid from said inlet manifold, through each of said fluid chambers, to said outlet manifold.

17. Droplet deposition apparatus comprising:

an array of fluid chambers, each fluid chamber defined by a pair of opposing chamber walls separated one from the other by a chamber wall separation, and in fluid communication with a nozzle for droplet ejection therefrom, each chamber wall deforming in shear mode in a chevron configuration upon application of an electric field thereto, wherein a top portion and a bottom portion of said chamber wall deform in opposite senses, and having an edge extending in a first direction, each of said fluid chambers extending in said first direction from a first longitudinal end to a second, opposing longitudinal end;

a fluid inlet manifold, in fluid communication with the first longitudinal ends of said fluid chambers;

a fluid outlet manifold, in fluid communication with the second longitudinal ends of said fluid chambers; and a compliant cover component having a cover thickness and being joined to said edges of said chamber walls, thereby being arranged to bound said chambers wherein said nozzles are formed in said cover member and said cover thickness is less than 150 μm.

18. Apparatus according to claim 17, wherein said cover member is formed of a polymer.

19. Apparatus according to claim 17, wherein cover thickness is less than 100 μm.

20. Apparatus according to claim 17, wherein cover thickness is less than 50 μm.

21. Apparatus according to claim 17, wherein each of said fluid chambers and said opposing chamber walls are elongate in said first direction.

22. Apparatus according to claim 17, wherein the cover member has a Young's modulus of less than or equal to $100\times10^9$ N/m$^2$.

23. Apparatus according to claim 17, wherein said compliant cover component extends beyond said chambers additionally to bound at least a portion of at least one of said fluid inlet manifold and said fluid outlet manifold.

24. Apparatus according to claim 17, wherein in use of the apparatus there is a flow of fluid from said inlet manifold, through each of said fluid chambers, to said outlet manifold.

* * * * *